US009327521B2

(12) United States Patent
Kanada et al.

(10) Patent No.: US 9,327,521 B2
(45) Date of Patent: May 3, 2016

(54) INK-JET PRINTER FOR DUPLEX PRINTING HAVING A PLURALITY OF HEADS

(71) Applicant: SEIKO EPSON CORPORATION, Tokyo (JP)

(72) Inventors: Hidemasa Kanada, Matsumoto (JP); Masato Mitsuhashi, Hara-mura (JP); Koji Higuchi, Shiojiri (JP); Toshimitsu Hirai, Hokuto (JP); Mitsuhiro Isobe, Kofu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/160,346

(22) Filed: Jan. 21, 2014

(65) Prior Publication Data

US 2014/0210920 A1 Jul. 31, 2014

(30) Foreign Application Priority Data

Jan. 28, 2013 (JP) ..... 2013-013444

(51) Int. Cl.

| | |
|---|---|
| ***B41J 2/01*** | (2006.01) |
| ***B41J 11/00*** | (2006.01) |
| ***B41M 7/00*** | (2006.01) |
| ***B41J 3/60*** | (2006.01) |
| ***B41J 15/04*** | (2006.01) |

(52) U.S. Cl.

CPC *B41J 11/002* (2013.01); *B41J 3/60* (2013.01); *B41J 15/04* (2013.01); *B41M 7/0081* (2013.01); *B41J 2202/21* (2013.01)

(58) Field of Classification Search

CPC ..... B41J 3/60

See application file for complete search history.

(56) References Cited

U.S. PATENT DOCUMENTS

| | | | | |
|---|---|---|---|---|
| 6,659,602 | B2 * | 12/2003 | Izawa et al. | 347/102 |
| 2012/0050433 | A1 | 3/2012 | Fujikura | |
| 2012/0062665 | A1 * | 3/2012 | Roof et al. | 347/99 |
| 2012/0113199 | A1 * | 5/2012 | Edwards | 347/102 |
| 2012/0133715 | A1 | 5/2012 | Izawa et al. | |
| 2012/0160114 | A1 * | 6/2012 | Otto et al. | 101/211 |

FOREIGN PATENT DOCUMENTS

JP 2008-087184 4/2008

OTHER PUBLICATIONS

European Search Report for Application No. 14152702.8 dated May 23, 2014.

* cited by examiner

*Primary Examiner* — Shelby Fidler
*Assistant Examiner* — Tracey McMillion
(74) *Attorney, Agent, or Firm* — Workman Nydegger

(57) ABSTRACT

A recording apparatus includes a plurality of line heads that discharge light curable inks onto a recording target material, a plurality of first light irradiators that are located at downstream side of transportation direction relative to the respective line heads in the transportation direction and emit light to the recording target material, a drum that is located at the downstream side relative to the first light irradiators in the transportation direction and forms a part of the transportation path, and a second light irradiator that is located opposite to a portion of the drum with which the transported recording target material makes contact and emits light to the contact portion. In the recording apparatus, the first light irradiators emit light for provisionally curing the discharged light curable inks, and the second light irradiator emits light for permanently curing the light curable inks, which have been provisionally cured, on the drum.

5 Claims, 4 Drawing Sheets

INK-JET PRINTER FOR DUPLEX PRINTING HAVING A PLURALITY OF HEADS

BACKGROUND

1. Technical Field

The present invention relates to a recording apparatus including a plurality of line heads that are arranged on a transportation path so as to be separated from one another in the transportation direction and discharge light curable inks onto a recording target material.

2. Related Art

As an existing recording apparatus, there is a recording apparatus as described in JP-A-2008-87184. JP-A-2008-87184 describes a printing apparatus that prints ultraviolet curable ink on a print target matter by a printing head, and irradiates the printed image with ultraviolet rays on a guide roller portion that is separated from the printing head toward the downstream side in the transportation direction so as to cure the ultraviolet curable ink. Alternatively, described is a printing apparatus that irradiates the printed image with ultraviolet rays on a region further downstream side relative to the guide roller so as to cure the ultraviolet curable ink.

In the existing recording apparatus, the printing head and the ultraviolet ray irradiation position are separated from each other in the transportation direction. Therefore, there is a risk that the printed image printed on the print target matter may bleed while it is moved to the ultraviolet ray irradiation position and irradiated with the ultraviolet rays so as to be cured.

In the recording apparatus having the configuration in which the plurality of line heads are arranged on the transportation path so as to be separated from one another in the transportation direction, there arises the following problem. That is, ultraviolet curable ink discharged from one line head is mixed with another ultraviolet curable ink that is discharged from another adjacent line head at the downstream side and bleeds. However, JP-A-2008-87184 does not refer to and indicate this problem.

SUMMARY

An advantage of some aspects of the invention is to reduce a risk that ultraviolet curable inks discharged from a plurality of line heads are mixed with one another to bleed, and to cure the inks in a state where a recording target material is made flat and is not wavily deformed in a recording apparatus having a configuration in which the line heads are arranged on a transportation path so as to be separated from one another in the transportation direction.

A recording apparatus according to a first aspect of the invention includes a transportation path on which a recording target material is transported, a plurality of line heads that are arranged on the transportation path so as to be separated from one another in a transportation direction and discharge light curable inks onto the recording target material, a plurality of first light irradiators that are located at downstream side respectively, relative to the line heads in the transportation direction and emit light to the recording target material, a drum that is located at the downstream side relative to the first light irradiators in the transportation direction and forms a part of the transportation path, and a second light irradiator that is located so as to face a portion of the drum with which the transported recording target material makes contact and emits light to the contact portion. In the recording apparatus, the first light irradiators emit light for provisionally curing the discharged light curable inks, and the second light irradiator emits light for permanently curing the light curable inks, which have been provisionally cured, on the drum.

The term "downstream side" in the expression "located at downstream side, respectively, relative to the line heads in the transportation direction" indicates "downstream side" relative to regions of the respective line heads, which are occupied by nozzle rows for discharging ink. That is, the term does not indicate downstream side relative to all the constituent components constituting line head units.

Further, the term "downstream side" in the expression "located at the downstream side relative to the first light irradiators in the transportation direction" indicates "downstream side" relative to regions of the first light irradiators, which are occupied by light irradiation ports for emitting light. That is, the term does not indicate the downstream side relative to all the constituent components constituting first light irradiator units.

The term "provisional curing" indicates that the light curable ink is cured to the extent that flow of the light curable ink landed on the recording target material, mixing with another ink to be discharged subsequently and ink bleeding are suppressed.

The term "permanent curing" indicates that irradiation of light energy is further performed after the "provisional curing" to the extent that the light curable ink is cured completely.

Note that the light energy is an integrated irradiation amount of light that is emitted to the recording medium per unit area. The light energy ($mJ/cm^2$) is defined by a product of a light irradiation intensity ($mW/cm^2$) and an irradiation time (s). The light energy necessary for curing the light curable ink in a provisionally cured state completely is smaller than the light energy necessary for curing the light curable ink in an uncured state completely.

According to the aspect of the invention, in the recording apparatus having the configuration in which the plurality of line heads are arranged on the transportation path so as to be separated from one another in the transportation direction, the first light irradiators emit ultraviolet rays so as to provisionally cure ultraviolet curable inks discharged from the respective line heads immediately after the discharge. This makes it possible to reduce a risk that the ultraviolet curable inks discharged from the respective line heads are mixed with one another to bleed.

Then, the second light irradiator emits light for permanent curing to the light curable inks in the provisionally cured states on the drum. Accordingly, the recording target material is supported on the drum and the light is emitted to the supported position. This makes it possible to cure the inks in a state where the recording target material is made flat and is not wavily deformed.

Further, polymerization heat is generated when the light curable inks are cured with the light irradiation. However, the polymerization heat is transferred to the drum, so that the increase in the temperature of the recording target material can be suppressed. This makes it possible to reduce a risk that the temperature of the recording target material on the transportation path is increased and recording quality is lowered.

In the recording apparatus according to a second aspect of the invention, it is preferable that the recording apparatus in the first aspect of the invention be a recording apparatus for duplex printing that executes recording on both surfaces of the recording target material, meanwhile the line heads include first line heads that discharge light curable inks onto one surface of the recording target material, and second line heads that discharge light curable inks onto the other surface of the recording target material, the first light irradiators include first light irradiators for the first line heads that are provided for the first line heads, and first light irradiators for the second line heads that are provided for the second line heads, the drum include a first drum that is located between the first light irradiators for the first line heads and the second line heads on the transportation path, and a second drum that is located on the transportation path at the downstream side relative to the first light irradiators for the second line heads, the second light irradiator includes a second light irradiator for the first drum that corresponds to the first drum, and a second light irradiator for the second drum that corresponds to the second drum, and the first drum and the second drum serve as reverse rollers that reverse front and back surfaces of the transported recording target material.

The term "between" in the expression "located between the first light irradiators for the first line heads and the second line heads" indicates "between" a region occupied by a light irradiation port of the first light irradiator for the first line head at the most-downstream side in the transportation direction and a region occupied by a nozzle row of the second line head at the most-upstream side in the transportation direction. That is, the term does not indicate a position between all the constituent components constituting units of the first light irradiators for the first line heads and all the constituent components constituting units of the second line heads.

The term "downstream side" in the expression "located on the transportation path at the downstream side relative to the first light irradiators for the second line heads" indicates "downstream side" relative to a region occupied by a light irradiation port of the first light irradiator for the second line head at the most-downstream side in the transportation direction. That is, the term does not indicate the downstream side relative to all the constituent components constituting units of the first light irradiators for the second line heads.

According to the aspect of the invention, in the recording apparatus for duplex printing, action effects same as those obtained in the first aspect of the invention are obtained by a set of the first line heads and the first light irradiators for the first line heads for performing recording on one surface of the recording target material and a set of the second line heads and the first light irradiators for the second line heads for performing recording on the other surface of the recording target material. That is to say, the first light irradiators for the first line heads emit ultraviolet rays so as to provisionally cure ultraviolet curable inks discharged onto one surface of the recording target material from the respective first line heads immediately after the discharge. Further, the first light irradiators for the second line heads emit ultraviolet rays so as to provisionally cure ultraviolet curable inks discharged onto the other surface of the recording target material from the respective second line heads after the reversal of the front and rear surfaces immediately after the discharge. This makes it possible to reduce a risk that the ultraviolet curable inks discharged from the respective line heads are mixed with one another to bleed as well in the recording apparatus for duplex printing.

Then, the second light irradiator for the first drum and the second light irradiator for the second drum emit light for permanent curing to the light curable inks in the provisionally cured states on the first drum and the second drum, respectively. Accordingly, the recording target material is supported on the drums and the light is emitted to the supported positions. This makes it possible to cure the inks in a state where the recording target material is made flat and is not wavily deformed.

Further, the first drum and the second drum serve as reverse rollers necessary for reversing the front and rear surfaces of the recording target material in the recording apparatus for duplex printing. Therefore, increase in the number of parts can be suppressed and the permanent curing can be effectively performed while reversing the front and rear surfaces of the recording target material.

In the recording apparatus according to a third aspect of the invention, it is preferable that the first drum and the second drum be located at lower sides relative to the units of the first line heads and the units of the second line heads, in the second aspect of the invention.

The term "units" in the expression "units of the first line heads and units of the second line heads" indicates that basic constituent members of the line heads, such as holding members holding head members on which nozzle rows are formed, in addition to the head members are included.

According to the aspect of the invention, the first drum and the second drum are located at the lower sides relative to the units of the first line heads and the units of the second line heads. Therefore, weight balance of the recording apparatus overall becomes stable. If the first drum and the second drum are located so as to be separated from each other in the horizontal direction at substantially the same height, the weight balance of the recording apparatus overall becomes more stable.

In the recording apparatus according to a fourth aspect of the invention, it is preferable that the second light irradiator for the first drum and the second light irradiator for the second drum emit light to the contact portions on the first drum and the second drum, respectively, from positions at sides opposite to the first line heads and the second line heads, in the third aspect of the invention.

The regions occupied by the nozzle rows on the first line heads and the second line heads correspond to outlets for ejecting the ultraviolet curable inks. If light for curing hits the outlets, the inks are cured and the nozzles are clogged, resulting in ink discharge failure.

According to the aspect of the invention, the light emitted from the second light irradiator for the first drum and the second light irradiator for the second drum is irradiated onto the recording target material on the drums, and then, is shielded by the drums, respectively. Therefore, there is almost no light directing toward the nozzle rows on the first line heads and the second line heads. This makes it possible to suppress generation of the nozzle clogging.

In the recording apparatus according to a fifth aspect of the invention, it is preferable that the transportation path transport a long recording target material continuously so as to partition the first line heads and the second line heads off the second light irradiator for the first drum and the second light irradiator for the second drum optically by the recording target material on the transportation path, in the third or fourth aspect of the invention.

According to the aspect of the invention, the first line heads and the second line heads can be partitioned optically off the second light irradiator for the first drum and the second light irradiator for the second drum by the recording target material on the transportation path. Therefore, the light emitted from the second light irradiator for the first drum and the second light irradiator for the second drum is shielded by the recording target material on the transportation path. Therefore, there is almost no light directing toward the nozzle rows on the first line heads and the second line heads. This makes it possible to suppress generation of the nozzle clogging.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIG. 1, FIG. 2

Figure 1:
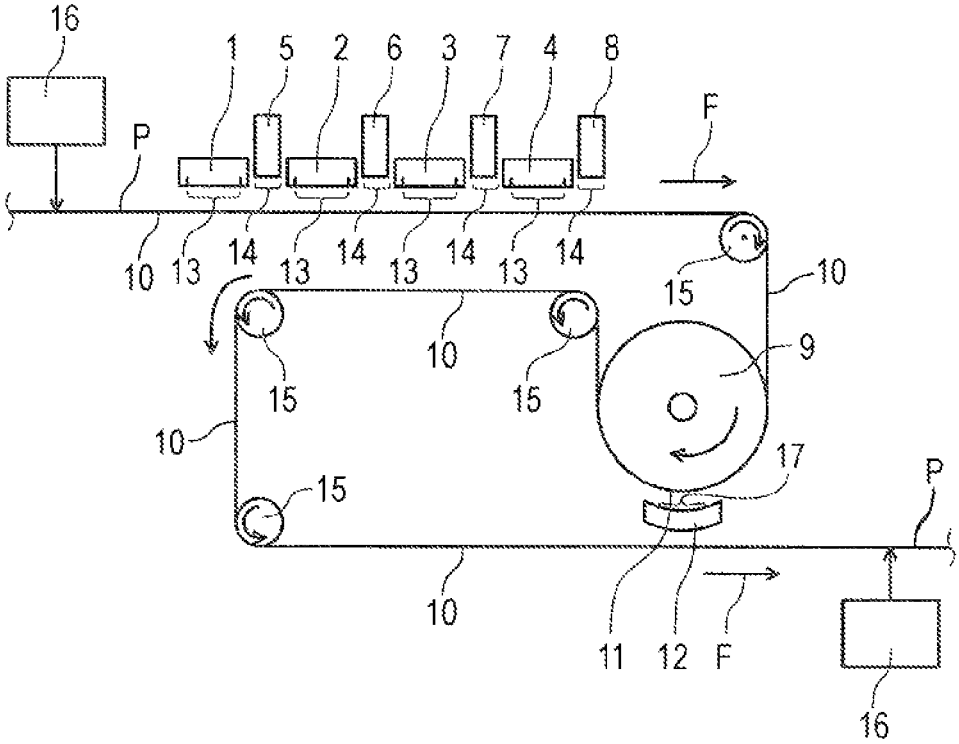
FIG. 1 is a schematic side view illustrating the main part of a recording apparatus according to a first embodiment of the invention.

Hereinafter, described is a recording apparatus according to a first embodiment of the invention in detail with reference to FIG. 1 and FIG. 2.

The recording apparatus in the first embodiment is an ink jet recording apparatus. The recording apparatus includes a transportation path 10 and a plurality of line heads 1, 2, 3, and 4. A recording target material P is transported on the transportation path 10. The line heads 1, 2, 3, and 4 are arranged on the transportation path 10 so as to be separated from one another in the transportation direction F to discharge light curable inks onto the recording target material P.

Further, the recording apparatus includes a plurality of first light irradiators 5, 6, 7, and 8, a drum 9, and a second light irradiator 12. The first light irradiators 5, 6, 7, and 8 are located at the downstream side relative to the line heads 1, 2, 3, and 4 in the transportation direction F, respectively. The first light irradiators 5, 6, 7, and 8 emit light to the recording target material P. The drum 9 is located at the downstream side relative to the plurality of first light irradiators 5, 6, 7, and 8 in the transportation direction F and forms a part of the transportation path 10. The second light irradiator 12 is located opposite to a portion 11 of the drum 9 with which the transported recording target material P makes contact and emits light to the contact portion 11.

The first light irradiators 5, 6, 7, and 8 emit light for provisionally curing the light curable inks discharged onto the recording target material P. The second light irradiator 12 emits light for permanently curing the light curable inks, which have been provisionally cured, on the drum 9.

The term "downstream side" in the expression "located at the downstream side of the line heads 1, 2, 3, and 4 in the transportation direction F, respectively" indicates "downstream side" relative to regions 13 of the line heads 1, 2, 3, and 4, which are occupied by nozzle rows for discharging inks.

Further, the term "downstream side" in the expression "located at the downstream side relative to the first light irradiators 5, 6, 7, and 8 in the transportation direction F" indicates "downstream side" relative to regions 14 of the first light irradiators 5, 6, 7, and 8, which are occupied by light irradiation ports for emitting light.

Since the meanings of the "provisional curing" and the "permanent curing" have been already described, description thereof is omitted here.

The line heads 1, 2, 3, and 4 are a Y ink head 1, an M ink head 2, a C ink head 3, and a K ink head 4 corresponding to ultraviolet curable inks of four colors of yellow (Y), magenta (M), cyan (C), and black (K), and are provided to be aligned as illustrated in FIG. 1. It is needless to say that the order of the alignment of the respective line heads 1, 2, 3, and 4 in the transportation direction F is not limited to that order as illustrated in FIG. 1.

Light emitting diodes (LEDs) that emit ultraviolet rays are used for light sources of the first light irradiators 5, 6, 7, and 8 for the provisional curing. The irradiation amounts of the ultraviolet rays from the LEDs can be changed easily by controlling the magnitude of input currents.

A lamp (metal halide, mercury lamp, or the like) that emits ultraviolet rays is used for a light source of the second light irradiator 12 for the permanent curing. It is to be noted that the light emitting diode may be used instead.

Figure 2:
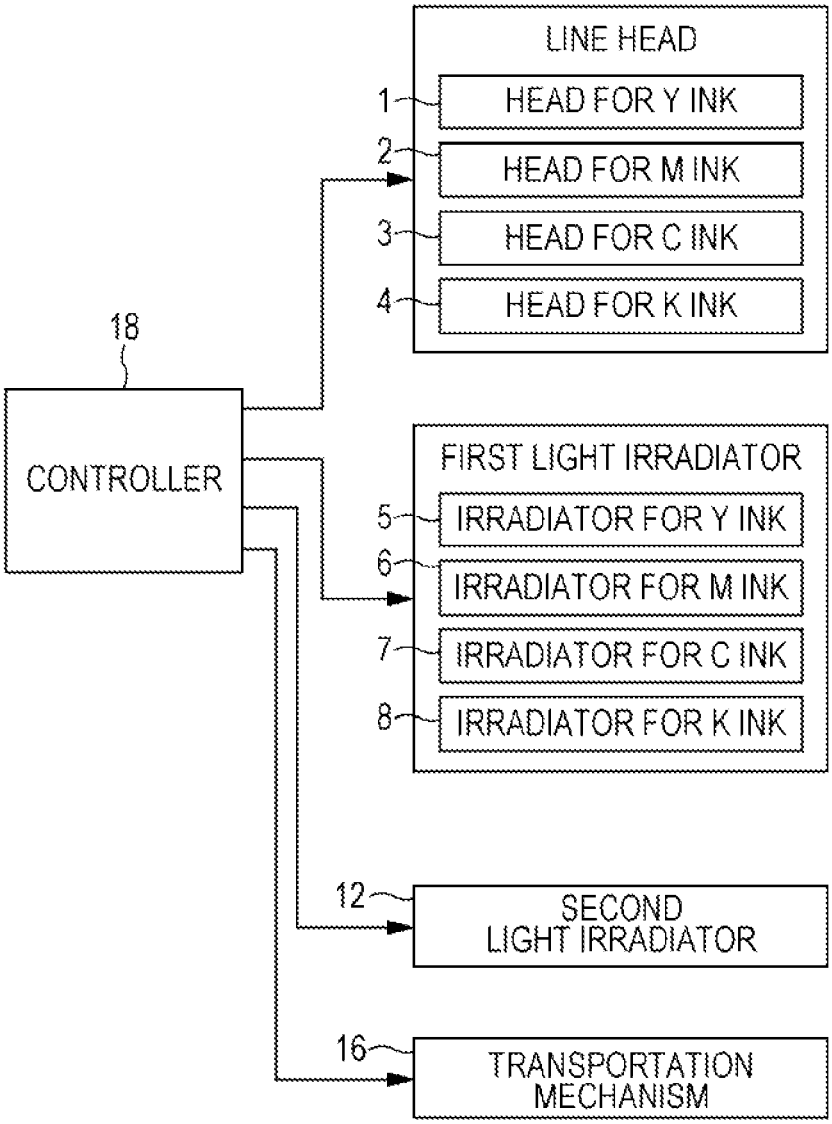
FIG. 2 is a block diagram for explaining control of the recording apparatus according to the first embodiment of the invention.

In FIG. 1 and FIG. 2, reference numerals 15 indicate feeding rollers for forming the transportation path 10, reference numerals 16 indicate transportation mechanisms for transporting the recording target material P, a reference numeral 17 indicates a region occupied by a light irradiation port through which the second light irradiator 12 emits light, and a reference numeral 18 indicates a controller.

The controller 18 controls drivings of the respective line heads 1, 2, 3, and 4, the respective first light irradiators 5, 6, 7, and 8, the second light irradiator 12, and the transportation mechanism 16 so as to execute desired recording by using the ultraviolet curable inks.

The drum 9 supports and transports the recording target material P on which the ultraviolet curable inks have been provisionally cured in a state where the recording target material P is made flat and is not wavily deformed. Therefore, the drum 9 is formed by a cylindrical body having a larger diameter than the feeding rollers 15. The recording target material is transported on and is pressed against the surface of the cylindrical body having the large diameter, so that the recording target material P is made flat and is not wavily deformed on the drum 9.

In the embodiment, the drum 9 also serves as a reverse roller. Therefore, the recording target material P is supported and transported in a state of winding approximately halfway around the surface of the drum 9. This realizes a state where the recording target material P is made flat and is not wavily deformed easily.

The region 17 occupied by the light irradiation port through which the second light irradiator 12 emits light is formed to be longer than each of the regions 14 occupied by the light irradiation ports through which the first light irradiators 5, 6, 7, and 8 emit light.

As the recording target material P, paper, a non-woven fabric, a synthetic chemical fabric, polyethylene, polyester, vinyl chloride, tarpaulin, and the like can be used regardless of the material property.

According to the first embodiment, in the recording apparatus having the configuration in which the plurality of line heads 1, 2, 3, and 4 are arranged on the transportation path 10 so as to be separated from one another in the transportation direction F, the first light irradiators 5, 6, 7, 8 emit ultraviolet rays so as to provisionally cure ultraviolet curable inks discharged from the respective line heads 1, 2, 3, and 4 immediately after the discharge. This makes it possible to reduce a risk that the ultraviolet curable inks discharged from the respective line heads 1, 2, 3, and 4 are mixed with one another to bleed.

Then, the second light irradiator 12 emits light for permanent curing to the light curable inks in the provisionally cured states on the drum 9. Accordingly, the recording target material P is supported on the drum 9 and the light is emitted to the supported position. This makes it possible to cure the inks in a state where the recording target material P is made flat and is not wavily deformed.

Further, polymerization heat is generated when the light curable inks are cured with the light irradiation. However, the polymerization heat is transferred to the drum 9, so that the increase in the temperature of the recording target material P can be suppressed. This makes it possible to reduce a risk that the temperature of the recording target material P on the transportation path 10 is increased and recording quality is lowered.

Second Embodiment

FIG. 3, FIG. 4

Figure 3:
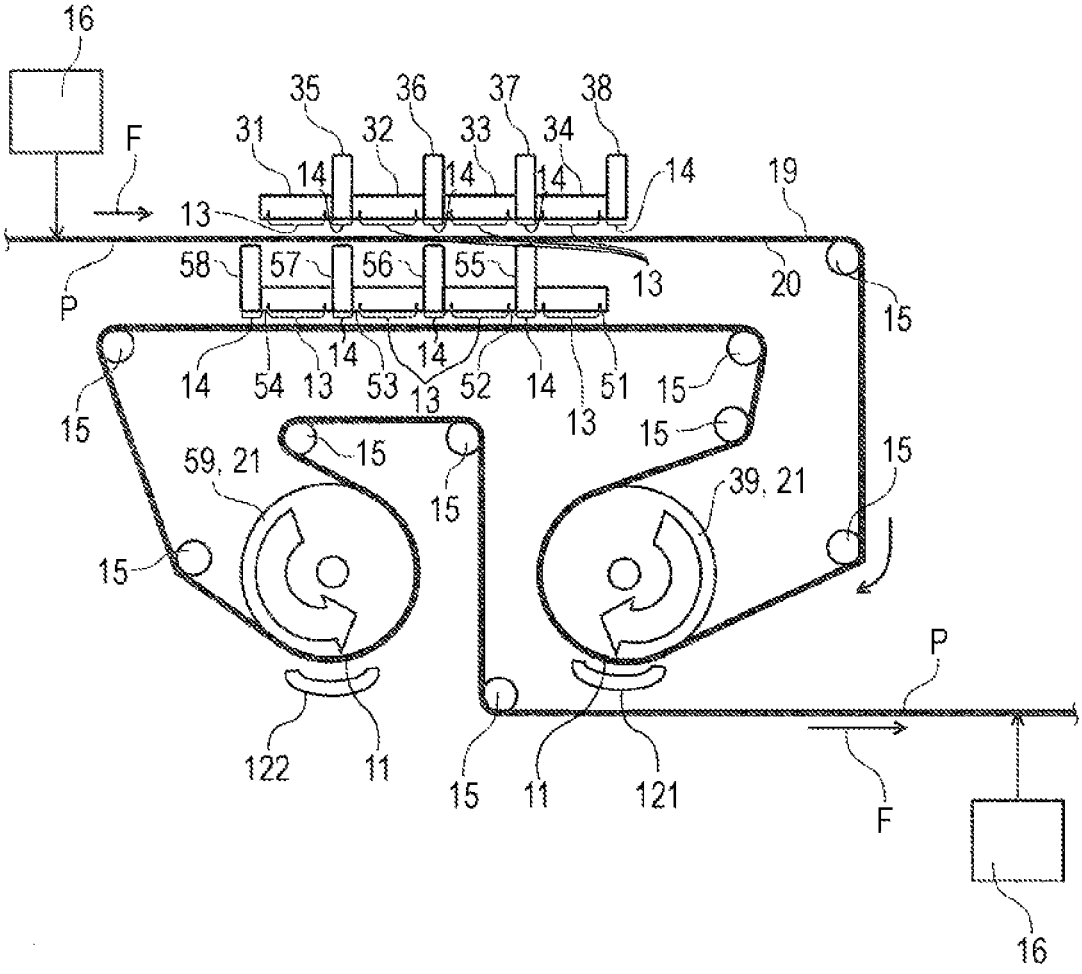
FIG. 3 is a schematic side view illustrating the main part of a recording apparatus according to a second embodiment of the invention.
Figure 4:
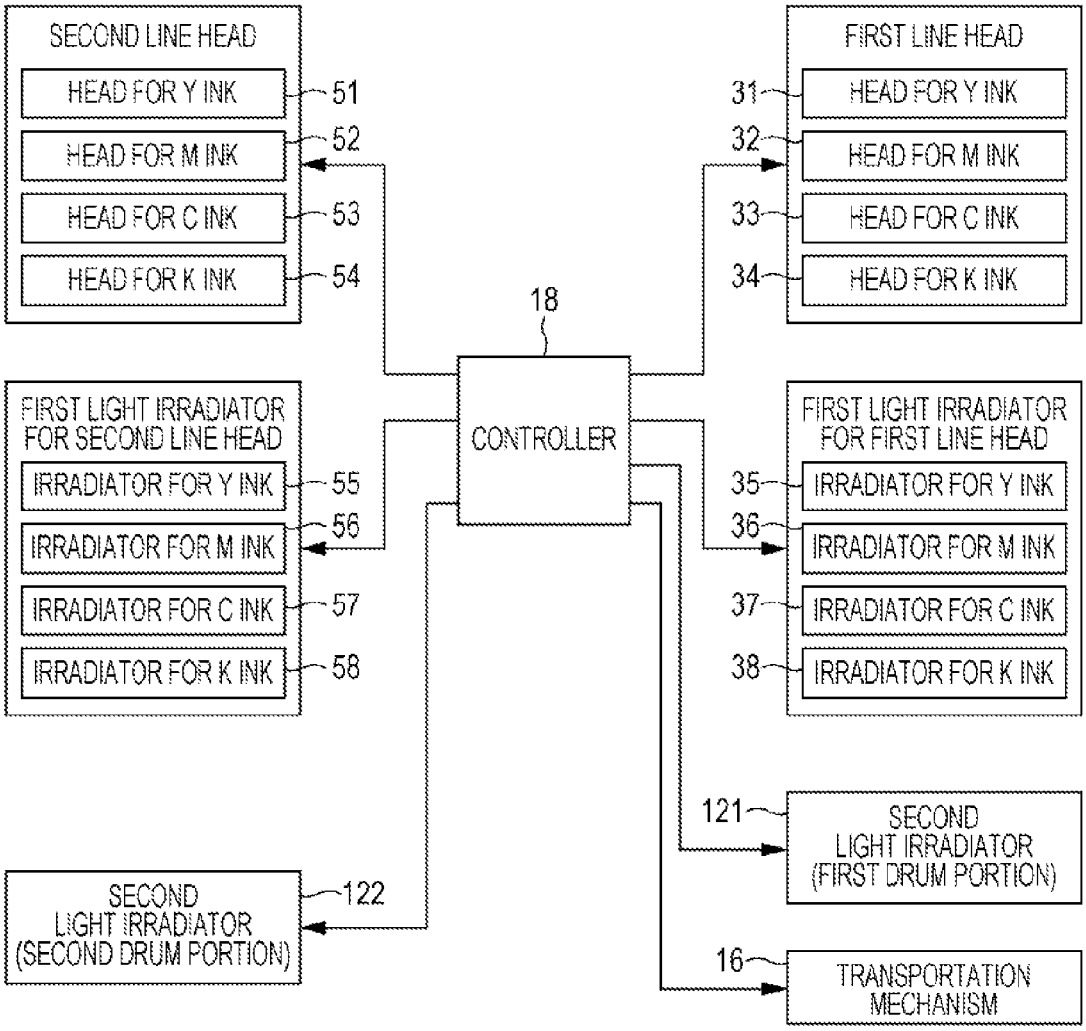
FIG. 4 is a block diagram for explaining control of the recording apparatus according to the second embodiment of the invention.

Described is a recording apparatus according to a second embodiment of the invention in detail with reference to FIG. 3 and FIG. 4.

The recording apparatus in the second embodiment is a recording apparatus for duplex printing that executes recording on both surfaces of the recording target material P.

The line heads include first line heads 31, 32, 33, and 34 and second line heads 51, 52, 53, and 54. The first line heads 31, 32, 33, and 34 discharge ultraviolet curable inks (light curable inks) onto one surface 19 of the recording target material P. The second line heads 51, 52, 53, and 54 discharge ultraviolet curable inks (light curable inks) onto the other surface 20 of the recording target material P. The first light irradiators include first light irradiators for the first line heads 35, 36, 37, and 38 and first light irradiators for the second line heads 55, 56, 57, and 58. The first light irradiators for the first line heads 35, 36, 37, and 38 are provided for the first line heads 31, 32, 33, and 34, respectively. The first light irradiators for the second line heads 55, 56, 57, and 58 are provided for second line heads 51, 52, 53, and 54, respectively.

The drum includes a first drum 39 and a second drum 59. The first drum 39 is located between the first light irradiators for the first line heads 35, 36, 37, and 38 and the second line heads 51, 52, 53, 54 on the transportation path 10. The second drum 59 is located on the transportation path 10 at the downstream side relative to the first light irradiators for the second line heads 55, 56, 57, and 58. The first drum 39 and the second drum 59 also serve as reverse rollers 21 that reverse the front and back surfaces of the transported recording target material P.

The second light irradiator includes a second light irradiator for the first drum 121 corresponding to the first drum 39 and a second light irradiator for the second drum 122 corresponding to the second drum 59.

The term "between" in the expression "located between the first light irradiators for the first line heads 35, 36, 37, and 38 and the second line heads 51, 52, 53, and 54" indicates "between" the region 14 occupied by a light irradiation port of the first light irradiator for the first line head 35, 36, 37, or 38 at the most-downstream side in the transportation direction F and the region 13 occupied by a nozzle row of the second line head 51, 52, 53, or 54 at the most-upstream side in the transportation direction F.

Further, the term "downstream side" in the expression "located on the transportation path 10 at the downstream side relative to the first light irradiators for the second line heads 55, 56, 57, and 58" indicates "downstream side" relative to the region 14 occupied by a light irradiation port of the first light irradiator for the first line head 55, 56, 57, or 58 at the most-downstream side in the transportation direction F.

In the second embodiment, the first drum 39 and the second drum 59 are located at the lower sides of the units of the first line head 31, 32, 33, 34 and the units of the second line head 51, 52, 53, 54.

The term "units" in the expression "units of the first line heads and the units of the second line heads" is used including basic constituent members of the line heads, such as holding members holding head members on which nozzle rows are formed, in addition to the head members.

In the second embodiment, the second light irradiator for the first drum 121 and the second light irradiator for the second drum 122 emit light to the contact portions 11 on the first drum 39 and the second drum 59, respectively, from positions at the sides opposite to the first line heads 31, 32, 33, and 34 and the second line heads 51, 52, 53, and 54.

The regions 13 occupied by the nozzle rows on the first line heads 31, 32, 33, and 34 and the second line heads 51, 52, 53, and 54 correspond to outlets for ejecting the ultraviolet curable inks. If light for curing hits the outlets, the inks are cured and the nozzles are clogged, resulting in ink discharge failure.

With this configuration, the light emitted from the second light irradiator for the first drum 121 and the second light irradiator for the second drum 122 is irradiated onto the recording target material P on the first drum 39 and the second drum 59, and then, is shielded by the drums 39 and 59, respectively. Therefore, there is almost no light directing toward the nozzle rows on the first line heads 31, 32, 33, and 34 and the second line heads 51, 52, 53, and 54. This makes it possible to suppress generation of the nozzle clogging.

In the second embodiment, the transportation path 10 transports a long recording target material P continuously so as to partition the first line head 31, 32, 33, and 34 and the second line heads 51, 52, 53, and 54 off the second light irradiator for the first drum 121 and the second light irradiator for the second drum 122 optically by the recording target material P on the transportation path 10.

With this configuration, the first line head 31, 32, 33, and 34 and the second line heads 51, 52, 53, and 54 and the second light irradiator for the first drum 121 and the second light irradiator for the second drum 122 can be partitioned optically by the recording target material P on the transportation path 10. Therefore, the light emitted from the second light irradiator for the first drum 121 and the second light irradiator for the second drum 122 is shielded by the recording target material on the transportation path 10. Therefore, there is almost no light directing toward the nozzle rows on the first line heads 31, 32, 33, and 34 and the second line heads 51, 52, 53, and 54. This makes it possible to suppress generation of the nozzle clogging.

Other configurations in the second embodiment are the same as those in the first embodiment. Therefore, the same reference numerals denote the same constituent components and description thereof is omitted.

According to the second embodiment, in the recording apparatus for duplex printing, action effects same as those obtained in the first embodiment are obtained by a set of the first line heads 31, 32, 33, and 34 and the first light irradiators for the first line heads 35, 36, 37, and 38 for performing recording on one surface 19 of the recording target material P and a set of the second line heads 51, 52, 53, and 54 and the first light irradiators for the second line heads 55, 56, 57, and 58 for performing recording on the other surface 20 of the recording target material P.

That is to say, the first light irradiators for the first line heads 35, 36, 37, and 38 emit ultraviolet rays so as to provisionally cure the ultraviolet curable inks discharged onto one surface 19 of the recording target material P from the respective first line heads 31, 32, 33, and 34 immediately after the discharge. Further, the first light irradiators for the second line heads 55, 56, 57, and 58 emit ultraviolet rays so as to provisionally cure ultraviolet curable inks discharged onto the other surface 20 of the recording target material P from the respective second line heads 51, 52, 53, and 54 after the reversal of the front and rear surfaces immediately after the discharge. This makes it possible to reduce a risk that the ultraviolet curable inks discharged from the respective line heads are mixed with one another to bleed in the recording apparatus for duplex printing.

Then, the second light irradiator for the first drum 121 and the second light irradiator for the second drum 122 emit light for permanent curing to the light curable inks in the provisionally cured states on the first drum 39 and the second drum 59, respectively. Accordingly, the recording target material P is supported on the drums 39 and 59 and the light is emitted to the supported positions. This makes it possible to cure the inks in a state where the recording target material P is made flat and is not wavily deformed.

Further, the first drum 39 and the second drum 59 also serve as reverse rollers 21 necessary for reversing the front and rear surfaces of the recording target material P in the recording apparatus for duplex printing. Therefore, increase in the number of parts can be suppressed and the permanent curing can be effectively performed while reversing the front and rear surfaces of the recording target material P.

According to the second embodiment, the first drum 39 and the second drum 59 are located at the lower sides of the units of the first line heads 31, 32, 33, and 34 and the units of the second line heads 51, 52, 53, and 54. Accordingly, weight balance of the recording apparatus overall becomes stable. If the first drum 39 and the second drum 59 are located so as to be separated from each other in the horizontal direction at substantially the same height, the weight balance of the recording apparatus overall becomes more stable.

The entire disclosure of Japanese Patent Application No. 2013-013444, filed Jan. 28, 2013 is expressly incorporated by reference here in.

What is claimed is:

1. A recording apparatus comprising:

a transportation path on which a recording target material is transported;

a plurality of line heads that are arranged on the transportation path so as to be separated from one another in a transportation direction and discharge light curable inks onto the recording target material in an ink discharge direction;

a plurality of first light irradiators that are located at downstream side relative to the line heads in the transportation direction, respectively, and emit light to the recording target material in the ink discharge direction;

a drum that is located at the downstream side relative to the first light irradiators in the transportation direction and forms a part of the transportation path, the drum receives the recording target material in the ink discharge direction, and perpendicular to the transportation direction at the plurality of line heads, and discharges the recording target material in a direction opposite to the ink discharge direction; and a second light irradiator that is located opposite to a portion of the drum with which the transported recording target material makes contact and emits light to the contact portion in the direction opposite to the ink discharge direction, wherein the first light irradiators emit light for provisionally curing the discharged light curable inks, and the second light irradiator emits light for permanently curing the light curable inks, which have been provisionally cured, on the drum, wherein each one of the plurality of line heads has an associated one of the first light irradiators that is directly downstream from each one of the plurality of line heads such that the light curable ink discharged by each one of the plurality of line heads is provisionally cured prior to being permanently cured by the second light irradiator to thereby prevent the light curable ink from spreading prior to being permanently cured.

2. The recording apparatus of claim 1, wherein the drum shields the plurality of line heads from the second light irradiator in the direction opposite to the discharge direction.

3. The recording apparatus of claim 1, wherein the contact portion is intermediate a portion of the drum which receives the recording target material and a portion of the drum from which the recording target material is discharged.

4. The recording apparatus of claim 3, wherein a portion of the recording target material is uncovered by the second light irradiator from the portion of the drum which receives the recording target material to the second light irradiator.

5. The recording apparatus of claim 3, wherein a portion of the recording target material is uncovered by the second light irradiator from the second light irradiator to the portion of the drum from which the recording target material is discharged.

* * * * *